US006166493A

United States Patent [19]

Cesarini

[11] Patent Number: 6,166,493

[45] Date of Patent: Dec. 26, 2000

[54] ELECTRIC MULTISPARK IGNITION SYSTEM, INSENSITIVE TO MOISTURE AND WET

[76] Inventor: Giacomo Salvatore Cesarini, via Giovanni 23°, 12 - 08036 Ortueri, Nuoro, Italy

[21] Appl. No.: 09/077,669

[22] PCT Filed: Oct. 30, 1997

[86] PCT No.: PCT/IT97/00267

§ 371 Date: Jun. 3, 1998

§ 102(e) Date: Jun. 3, 1998

[87] PCT Pub. No.: WO98/19110

PCT Pub. Date: May 7, 1998

[30] Foreign Application Priority Data

Oct. 31, 1996 [IT] Italy ..... RM96A0748

[51] Int. Cl.[7] ..... H05B 37/02

[52] U.S. Cl. ..... 315/209 PZ; 361/253; 361/260; 310/311

[58] Field of Search ..... 315/209 PZ, 55; 361/253, 255, 260; 431/254, 255, 258, 263, 264; 310/311, 339

[56] References Cited

U.S. PATENT DOCUMENTS

| | | | |
|---|---|---|---|
| 3,558,903 | 1/1971 | Yamano | 310/8.7 |
| 3,639,788 | 2/1972 | Horan | 310/8.1 |
| 3,793,561 | 2/1974 | Lundh | 431/255 X |
| 4,595,352 | 6/1986 | Endelson | 431/254 |
| 4,691,136 | 9/1987 | Schmidt | 310/339 |

*Primary Examiner*—Haissa Philogene

*Attorney, Agent, or Firm*—Smith, Gambrell & Russell, LLP Beveridge, DeGrandi, Weilacher & Young Intellectual Property Group

[57] ABSTRACT

An electric multispark ignition system, insensitive to moisture and wet, comprises a covering structure (1) for the piezoelectric crystals block (2) and an electric insulation means with electrodes (8, 9), completely insulated for their whole length (10) and with only one limited area (11) uncovered.

4 Claims, 1 Drawing Sheet

ELECTRIC MULTISPARK IGNITION SYSTEM, INSENSITIVE TO MOISTURE AND WET

BACKGROUND OF THE INVENTION

The present invention concerns an electric multispark ignition system, insensitive to moisture and wet.

At present, the production of systems for the electric spark ignition consists of piezoelectric igniters and in the so-called electronic igniters.

The latter, of recent introduction, are widespread in spite of their higher cost, as they seem to be less sensitive to moisture than the piezoelectric igniters, which show many disadvantages, mainly consisting of:

an extreme sensitivity to moisture of the crystal block: in fact, as the moisture makes a deposit of a thin layer on their surfaces, it determines—due to the high potential differences between the positive and the negative area, a way to short-circuit with a too weak or nul production of sparks at the electrodes;

the arrangement and the structure of the point electrodes, common in the whole current production, which cause—in presence of moisture, condensation or wet—a partial or total short-circuit, with the emission of non uniform or too weak sparks, up to the non emission.

While in the electronic gas-lighters the insufficient efficiency of the crystal block lever has been solved by replacing the same with an electromagnetic spark generator fed by an electric energy source (battery, etc.), the problem of the point electrodes—in the electronic gas-lighters—has remained unvaried, and thus said electrodes are still sensitive to condensations of a determined extent or to wet.

It is the aim of the present invention to realize a new system which, without changing considerably the current technology and the techniques for the realization of piezoelectric lighters, may show a global efficiency superior to the one of an electronic lighter, maintaining the production costs of a common piezoelectric lighter, and therefore much lower.

SUMMARY OF THE INVENTION

The aim set forth is reached by means of the new system according to the present invention, which consists in a protection system of the piezoelectric crystals block, which makes the same insensitive to moisture, and with a cap completely different from those of current production, that may be used in any kind of piezoelectric, electronic, electric igniter for cooking places, ignition systems for industrial use like boilers etc.

The main and conclusive advantage of the system according to the present invention is that the flashing of a spark may be obtained in any moisture or even wet condition.

BRIEF DESCRIPTION OF THE SEVERAL VIEWS OF THE DRAWINGS the system according to the present invention will be described more in detail hereinbelow relating to the enclosed drawings in which some embodiments are shown.

DETAILED DESCRIPTION OF INVENTION

Figure 1:
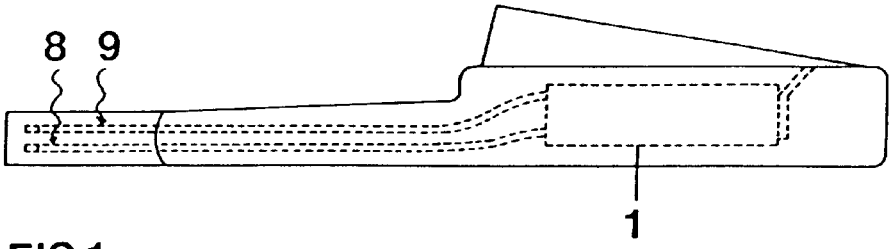
FIG. 1 shows a lateral scheme of an electric multispark ignition system, insensitive to moisture and wet, according to the present invention.
Figure 2:
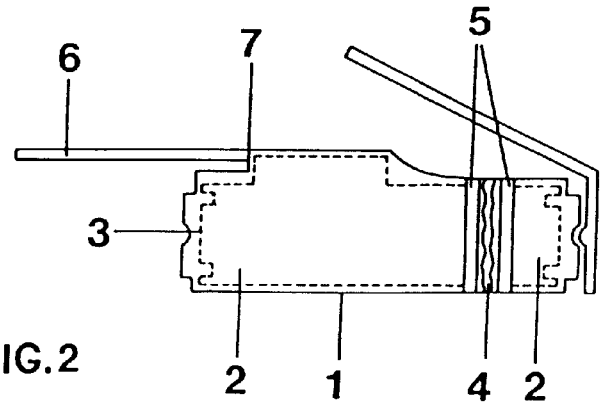
FIGS. 2 and 3 show a detail of the two elements cooperating for the purpose.
Figure 3:
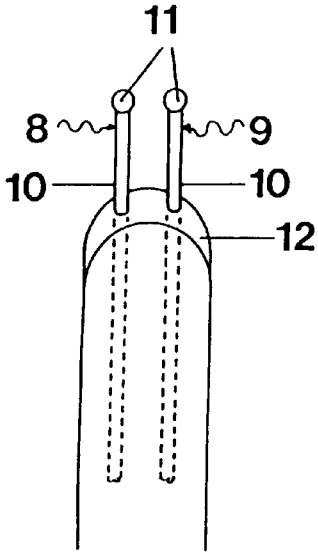

The enclosed figures show an electric multispark ignition system, insensitive to moisture and wet, mainly consisting of:

a structure 1 for the covering of the piezoelectric crystals block 2, consisting of cylindric prolongations of the thrust blocks so that each block pushes a prolongation that coats the plastic container 3, nearly reaching, but never touching, the opposite metal prolongation of the other block, so that the space 4 thereinbetween allows the sliding of the two metal parts, while the holding is secured by an elastic band 5 that surrounds the metal near the empty space and the positive wire 6 comes out of a sealing hole 7;

an electric insulation means that prevents electromagnetic interaction as well as short-circuit phenomena, consisting of two electrodes 8, 9 of suitable length and that limit the electric charges within a determined area of said electrodes, preventing any leakage beyond the one of the opposite lateral electrode, being completely insulated for all its length 10 against the existing tensions, leaving uncovered only a limited, more expanded area 11, placed at the furthermost so that the electrons, that charge the point of the electrode, should run along the distance of the wet layer that covers the two electrodes, for getting into short-circuit and reaching the opposite pole; the suitable length of the two electrodes makes that the resistance of the wet to the passage of the electrons onto both electrodes is higher than the one opposed to the air space between the two points of said electrodes (and this also due to the possible discontinuity of the water layer); therefore, the jump spark have an obliged way which is always the same, in the dry air as well as with moisture and even with a wet cap.

Figure 4:
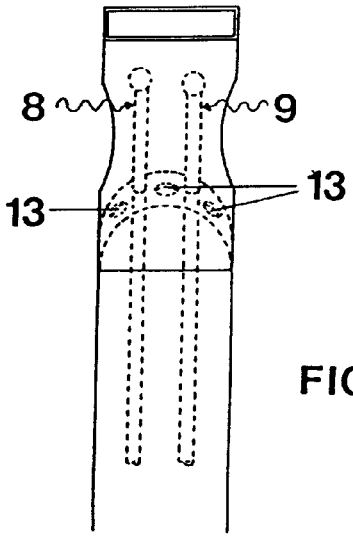
FIG. 4 shows an axonometric scheme of a variant of an end structure of an igniter provided with the system according to the present invention.

In the functional variant shown in FIG. 4, the system according to the present invention secures, by means of the more or less spheric shape of the plastic surface 12 from which the electrodes project, a quick draining of the liquid, which can flow away through the drainage holes 13 provided onto the metal burner, so as to avoid that a moisture excess (as could occur with water jets, steam jets or accidental fall into the water) collects at the base, filling it up and thus reducing the distance between the uncovered parts of the electrodes.

According to the present invention, one single electrode with above mentioned features (length of the run etc.) could be used, using—as in the common lighters—the metal burner as a second electrode. However, tests have shown that in some cases said shape causes non uniform sparks with following non perfect functioning of the lighter: therefore, it is suggested to make use of two electrodes.

What is claimed is:

1. An electric multispark ignition system, insensitive to moisture and wet, characterized in:

a structure (1) for the covering of a piezoelectric crystals block (2), consisting of cylindric prolongations of thrust blocks so that each block pushes a prolongation that coats a plastic container (3), nearly reaching, but never touching, an opposite metal prolongation of another block, so that space (4) therein between allows the sliding of metal parts, while holding is secured by an elastic band (5) that surrounds metal near empty space and a positive wire (6) comes out of a sealing hole (7);

an electric insulation means that prevents electromagnetic interaction as well as short circuit phenomena, consisting of two electrodes (8, 9) completely insulated for all their (10) and with only one limited area (11) uncovered so that resistance of wet to passage of electrons onto both electrodes is higher than one opposed to air space between two points of said electrodes, and therefore a jump spark has an obliged way which is always the same, in dry air as well as with moisture and even with a wet cap.

2. An ignition system according to claim 1, characterized in the presence of drainage holes (13) on a metal burner for a quick drainage of a liquid, that can flow away on a surface (12) from which project the electrodes.

3. An ignition system according to claim 1 characterized in the sole covering structure (1) of the piezoelectric crystals block (2).

4. An ignition system according to claim 1 characterized in the presence of the sole electric insulation means with electrodes (8, 9, 10, 11).

* * * * *